US008728300B2

(12) United States Patent
Iqbal et al.

(10) Patent No.: US 8,728,300 B2
(45) **Date of Patent: *May 20, 2014**

(54) FLASH PROCESSING A SOLVENT DEASPHALTING FEED

(75) Inventors: Rashid Iqbal, Houston, TX (US); Odette Eng, Sugar Land, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 573 days.

This patent is subject to a terminal disclaimer.

(21) Appl. No.: 12/905,802

(22) Filed: Oct. 15, 2010

(65) Prior Publication Data

US 2012/0091032 A1 Apr. 19, 2012

(51) Int. Cl.
*C10C 1/04* (2006.01)

(52) U.S. Cl.
USPC ..... 208/41; 208/309

(58) Field of Classification Search
USPC ..... 208/41
See application file for complete search history.

(56) References Cited

U.S. PATENT DOCUMENTS

| | | | | |
|---|---|---|---|---|
| 2,965,559 | A * | 12/1960 | McLaren | 208/41 |
| 4,317,711 | A | 3/1982 | Yan | |
| 4,347,118 | A | 8/1982 | Funk et al. | |
| 4,354,928 | A | 10/1982 | Audeh et al. | |
| 4,486,295 | A | 12/1984 | Inooka | |
| 4,781,819 | A | 11/1988 | Chirinos et al. | |
| 4,915,819 | A | 4/1990 | Chirinos et al. | |
| 5,024,750 | A | 6/1991 | Sughrue, II et al. | |
| 5,192,421 | A | 3/1993 | Audeh et al. | |
| 5,244,565 | A | 9/1993 | Lankton et al. | |
| 5,302,282 | A | 4/1994 | Kalnes et al. | |
| 5,980,732 | A | 11/1999 | Gillis | |
| 6,054,496 | A | 4/2000 | Crane et al. | |
| 6,245,222 | B1 | 6/2001 | Varadaraj et al. | |
| 6,274,003 | B1 | 8/2001 | Friday et al. | |
| 6,274,030 | B1 | 8/2001 | Wallace et al. | |
| 6,464,856 | B1 | 10/2002 | Di Tullio | |
| 6,524,469 | B1 | 2/2003 | Schucker | |
| 6,645,369 | B1 | 11/2003 | Boyer et al. | |
| 6,673,231 | B2 | 1/2004 | Kim et al. | |
| 6,702,936 | B2 | 3/2004 | Rettger et al. | |
| 7,033,486 | B2 | 4/2006 | Gorbaty et al. | |
| 7,297,250 | B2 | 11/2007 | Bronicki | |
| 7,381,320 | B2 | 6/2008 | Iqbal et al. | |
| 7,601,254 | B2 * | 10/2009 | Gosling | 208/59 |
| 7,622,035 | B2 | 11/2009 | Zaki et al. | |
| 7,691,256 | B2 | 4/2010 | Montanari et al. | |
| 7,736,493 | B2 | 6/2010 | Leta et al. | |
| 7,749,378 | B2 | 7/2010 | Iqbal et al. | |
| 2001/0002654 | A1 * | 6/2001 | Hood et al. | 208/309 |
| 2003/0019790 | A1 | 1/2003 | Schucker | |

(Continued)

*Primary Examiner* — Randy Boyer
*Assistant Examiner* — Juan Valencia
(74) *Attorney, Agent, or Firm* — Gary M. Machetta

(57) ABSTRACT

Systems and methods for deasphalting a hydrocarbon are provided. A hydrocarbon can be heated to a first temperature and pressurized to a first pressure. The pressurized hydrocarbon can be depressurized to separate at least a portion of the hydrocarbon to provide a vaporized hydrocarbon mixture and a residual hydrocarbon that can include asphaltenes. The residual hydrocarbon can be mixed with a solvent to provide a first mixture. The first mixture can be heated to a second temperature. The asphaltenes can be separated from the first mixture to provide a first product and a second product. The first product can include a deasphalted oil and at least a portion of the solvent. The second product can include the asphaltenes and the remaining portion of the solvent.

19 Claims, 3 Drawing Sheets

(56) References Cited

U.S. PATENT DOCUMENTS

| | | | | |
|---|---|---|---|---|
| 2003/0129109 | A1 | 7/2003 | Bronicki | |
| 2004/0055208 | A1 | 3/2004 | Chakrabarty et al. | |
| 2004/0069685 | A1 | 4/2004 | Inomata et al. | |
| 2004/0072361 | A1 | 4/2004 | Varadaraj et al. | |
| 2006/0000749 | A1 | 1/2006 | Varadaraj et al. | |
| 2006/0032789 | A1 | 2/2006 | Bronicki | |
| 2006/0042999 | A1 | 3/2006 | Iqbal et al. | |
| 2006/0116450 | A1 | 6/2006 | Buras et al. | |
| 2006/0157385 | A1 | 7/2006 | Montanari et al. | |
| 2006/0163115 | A1 | 7/2006 | Montanari et al. | |
| 2006/0249439 | A1 | 11/2006 | Garner et al. | |
| 2006/0283776 | A1 | 12/2006 | Iqbal et al. | |
| 2008/0093260 | A1 | 4/2008 | Koseoglu | |
| 2008/0099371 | A1 | 5/2008 | McCoy et al. | |
| 2008/0223754 | A1* | 9/2008 | Subramanian et al. | 208/86 |
| 2008/0230442 | A1 | 9/2008 | Iqbal et al. | |
| 2009/0020453 | A1 | 1/2009 | Tanaka et al. | |
| 2010/0032340 | A1 | 2/2010 | Zaki et al. | |
| 2010/0243518 | A1* | 9/2010 | Zimmerman et al. | 208/45 |
| 2011/0094937 | A1* | 4/2011 | Subramanian et al. | 208/40 |

* cited by examiner

FLASH PROCESSING A SOLVENT DEASPHALTING FEED

BACKGROUND

1. Field

Embodiments of the present disclosure generally relate to methods for treating hydrocarbons. More particularly, embodiments of the present disclosure relate to methods for deasphalting hydrocarbons.

2. Description of the Related Art

The supply of light, sweet, crude oil is diminishing, requiring refineries to process heavier crude feed stocks such as those produced in Western Canada, Venezuela, Russia and the United States. While varying widely in composition, these heavy crude hydrocarbons generally have similar characteristics: API gravity of less than 25; high metal content, especially nickel and vanadium; high sulfur, nitrogen and oxygen content; and high levels of Conradson Carbon Residue ("CCR"). The heavy crude oils can also have high acid content measured as Total Acid Number (TAN). Since these heavy crude hydrocarbons generally do not flow at ambient conditions, treatment at the point of extraction is often necessary prior to introducing the heavy crude hydrocarbons to the transportation network, i.e. pipelines Solvent deasphalting has been used to remove high viscosity asphaltenic compounds from heavy crude hydrocarbons, providing a low viscosity deasphalted oil suitable for transportation. Additionally, the deasphalted oil has a reduced concentration of the metals content and CCR levels as compared to the heavy crude hydrocarbons. The asphaltenic compounds contain the majority of the metals, CCR, sulfur containing compounds, nitrogen containing compounds, and the like. A disadvantage of solvent deasphalting, however, is that the light hydrocarbons in the heavy crude hydrocarbon can degrade the efficiency of the solvent used in the deasphalting process. To prevent this degradation, the heavy crude hydrocarbons are typical pretreated to separate and remove the light hydrocarbons prior to solvent deasphalting. Typical pretreatment processes include atmospheric distillation and vacuum distillation.

However, the installation of one or more pretreatment processes in addition to one or more solvent deasphalting processes, at the point of extraction can have multiple drawbacks. Such drawbacks include: increasing the overall footprint of the solvent deasphalting process to include one or more upstream treatment processes: increasing quantity and complexity of equipment required to pretreat the heavy crude; increasing initial capital cost; increasing ongoing operating costs; and reducing overall reliability of the solvent deasphalting process due to the increase in mechanical components.

There is a need, therefore, for an improved, more economical, and/or more efficient process for pretreating a heavy crude hydrocarbon prior to solvent deasphalting.

BRIEF DESCRIPTION OF THE DRAWINGS

So that the recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
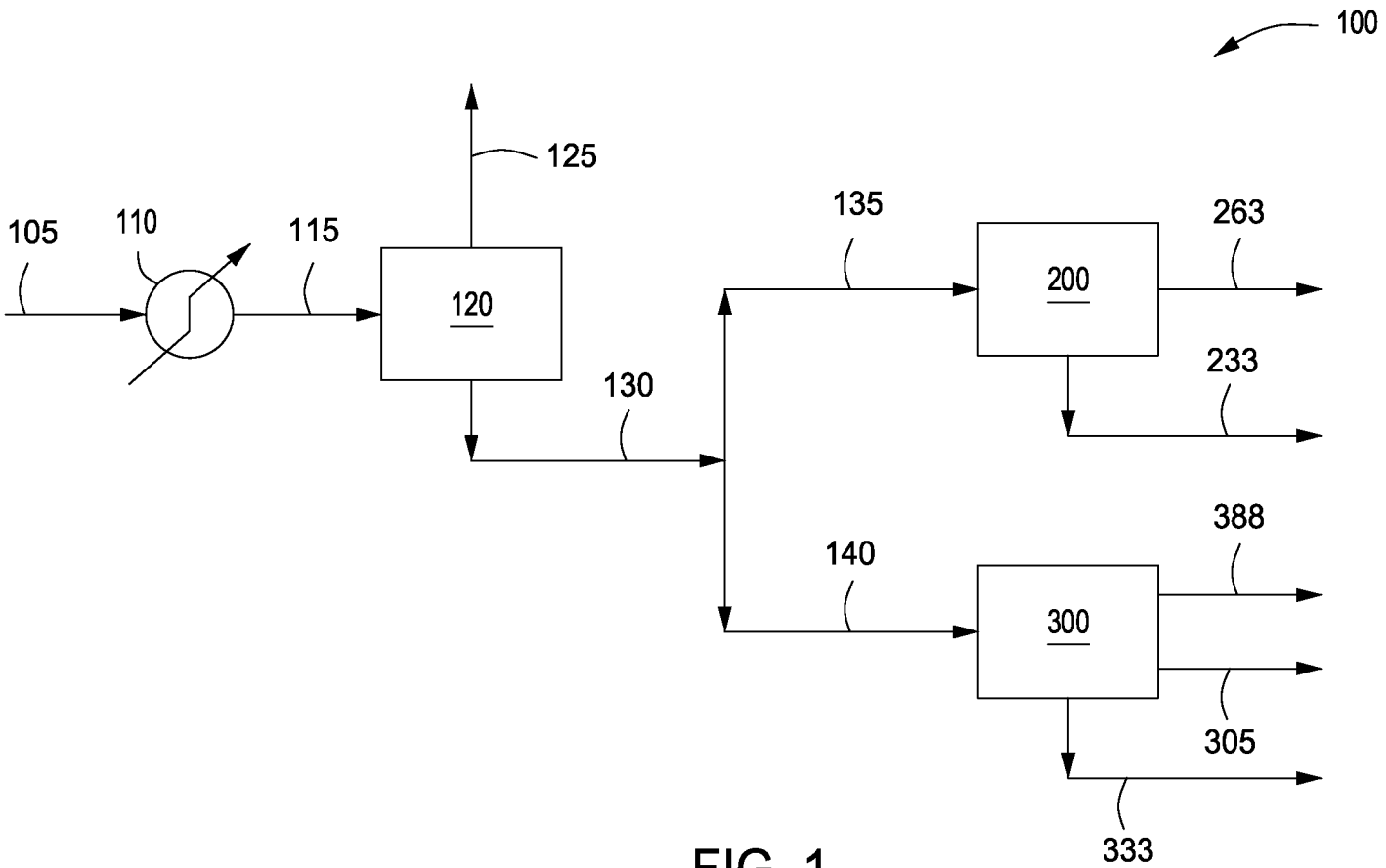
FIG. 1 depicts a schematic of an illustrative hydrocarbon treatment system according to one or more embodiments described.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Systems and methods for deasphalting a hydrocarbon are provided. A hydrocarbon can be heated to a first temperature and pressurized to a first pressure. The pressurized hydrocarbon can be depressurized to separate at least a portion of the hydrocarbon to provide a vaporized hydrocarbon mixture and a residual hydrocarbon that includes asphaltene. The residual hydrocarbon can be mixed with a solvent to provide a first mixture. The first mixture can be heated to a second temperature. The asphaltenes can be separated from the first mixture to provide a first product and a second product. The first product can include deasphalted oil and at least a portion of the solvent. The second product can include the asphaltenes and the remaining portion of the solvent.

As used herein, the term "hydrocarbon" can refer to one or more hydrocarbon compounds including, but not limited to, whole crude oil, crude oil, oil shales, oil sands, tars, bitumens, kerogen, pitch, derivatives thereof, or any combination thereof. The hydrocarbon can have a bulk API specific gravity (API at 15.6° C.—ASTM D4052) of about 35° or less, about 25° C. or less, about 20° or less, about 15° or less, or about 10° or less. For example, the hydrocarbon can have a bulk API specific gravity (API at 15.6°) ranging from a low of about −12, about −5, about 0, or about 5 to a high of about 15, about 20, about 25, about 30, or about 35. In another example, the hydrocarbon can have a bulk API specific gravity (API at 15.6° C.) of from about 6° to about 25°; about 7° to about 23°; about 8° to about 19°; or about 8° to about 15°. In one or more embodiments, the hydrocarbon can have a bulk normal, atmospheric boiling point ranging from a low of about 500° C., about 540° C., about 590° C., or about 640° C. to a high of about 700° C., about 800° C., about 900° C., about 950° C., about 1,000° C., or about 1,090° C.

As used herein, the terms "solvent" and "solvents" can refer to one or more alkane or alkene hydrocarbons having three to seven carbon atoms ($C_3$ to $C_7$), mixtures thereof, derivatives thereof, or any combination thereof. In one or more embodiments, the solvent can have a normal boiling point (for pure solvents) or bulk normal boiling point (for solvent mixtures) of less than about 538° C.

As used herein, the terms "asphaltene," "asphaltenes," "asphaltenic hydrocarbon," and "asphaltenic hydrocarbons" can refer to one or more hydrocarbons that are insoluble in n-alkanes, yet are totally or partially soluble in aromatics such as benzene or toluene. Asphaltenes can consist primarily of carbon, hydrogen, nitrogen, oxygen, sulfur, vanadium, and/or nickel. Asphaltenes can have a carbon to hydrogen ("C:H") ratio of about 1:2; about 1:1.5; about 1:1.2; or about 1:1. In one or more embodiments, asphaltenes can be an n-heptane ($C_7H_{16}$) insoluble and toluene ($C_6H_5CH_3$) soluble component of a carbonaceous material such as crude oil, bitumen, or coal.

FIG. 1 depicts a schematic of an illustrative hydrocarbon treatment system 100, according to one or more embodiments. The hydrocarbon treatment system 100 can include one or more heaters 110, one or more flash separation units (only one is shown) 120, one or more two-stage solvent extraction systems (only one is shown) 200, and one or more three-stage solvent extraction systems (only one is shown) 300. The one or more heaters 110 can heat or pre-heat, all or a portion of a hydrocarbon introduced via line 105. The heated hydrocarbon in line 115 exiting the heater 110 can be separated in the flash separation unit 120 to provide one or more volatile hydrocarbons via line 125 and one or more residual hydrocarbons via line 130.

In one or more embodiments, prior to heating the hydrocarbon in line 105 in heater 110, the hydrocarbon can be subjected to minimal or no processing. In one or more embodiments, prior to heating the hydrocarbon in line 105 in heater 110, the hydrocarbon can be subjected to no processing. In other words, the hydrocarbon in line 105 can be in its original or "raw" state as recovered from its source. For example, the hydrocarbon in line 105 can be introduced to the heater 110 as recovered from its source, e.g. an underground formation. In another example, the hydrocarbon in line 105 can undergo processing that can reduce or remove at least a portion of any water contained in the hydrocarbon in line 105 prior to introducing the hydrocarbon to the heater 110. In at least one specific example, vacuum distillation and/or atmospheric distillation of the hydrocarbon in line 105 can be avoided. In another example, the hydrocarbon in line 105 can be or include an atmospheric tower bottoms.

All or a portion of the residual hydrocarbons in line 130 can be introduced to the two-stage solvent extraction system 200 via line 135. All or a portion of the residual hydrocarbons in line 130 can be introduced to the three-stage solvent extraction system 300 via line 140. In another example, a first portion of the residual hydrocarbons in line 130 can be introduced via line 135 to the two-stage solvent extraction system 200 and a second portion can be introduced via line 140 to the three-stage solvent extraction system 300.

The hydrocarbon in line 105 can include one or more $C_1$-$C_{100}$ compounds. The hydrocarbon in line 105 can contain one or more asphaltenes, naphthenes, aromatic hydrocarbons, paraffinic hydrocarbons, heavy metals, or any combination thereof. The hydrocarbon in line 105 can have an asphaltene concentration ranging from a low of about 5 percent by weight ("wt %"), about 10 wt %, or about 15 wt % to a high of about 20 wt %, about 25 wt %, or about 30 wt %. The hydrocarbon in line 105 can have a naphthene concentration ranging from a low of about 5 wt %, about 10 wt %, or about 13 wt % to a high of about 18 wt %, about 20 wt %, or about 25 wt %. The hydrocarbon in line 105 can have an aromatic hydrocarbon concentration ranging from a low of about 5 wt %, about 10 wt %, or about 13 wt % to a high of about 18 wt %, about 20 wt %, or about 25 wt %. The hydrocarbon in line 105 can have a paraffinic hydrocarbon concentration ranging from a low of about 50 wt %, about 60 wt %, or about 63 wt % to a high of about 70 wt %, about 75 wt %, or about 85 wt %. The one or more heavy metals can include, but are not limited to, nickel and/or vanadium. The hydrocarbon in line 105 can have a nickel concentration ranging from a low of about 25 parts per million by weight ("ppmw"), about 50 ppmw, or about 100 ppmw to a high of about 200 ppmw, about 300 ppmw, about 500 ppmw, or about 1,000 ppmw. The hydrocarbon in line 105 can have a vanadium concentration ranging from a low of about 100 ppmw, about 125 ppmw, or about 250 ppmw to a high of about 500 ppmw, about 750 ppmw, or about 1,000 ppmw or more.

The hydrocarbon in line 105 can include one or more inert materials, for example sands, shales, clays, silts, or any combination thereof. the hydrocarbon in line 105 can have an inert material(s) concentration ranging from a low of about 1 wt %, about 2 wt %, about 5 wt %, or about 10 wt % to a high of about 35 wt %, about 40 wt %, about 50 wt %, or about 70 wt %. The hydrocarbon in line 105 can include one or more oil shales. The hydrocarbon in line 105 can include one or more tar sands saturated with bitumen. The hydrocarbon in line 105 can have a bitumen concentration ranging from a low of about 1 wt %, about 3 wt %, about 5 wt %, or about 8 wt % to a high of about 15 wt %, about 20 wt %, about 25 wt %, or about 30 wt %. In one or more embodiments, bitumen that can be contained in the hydrocarbon in line 105 can have a maximum sulfur content of about 2 wt %, about 3 wt %, about 4 wt %, about 5 wt %, or about 6 wt %. In one or more embodiments, the bitumen that can be contained in the hydrocarbon in line 105 can have a maximum aromatics content of about 20 wt %, about 25 wt %, about 30 wt %, about 35 wt %, or about 40 wt %.

The temperature of the one or more heated hydrocarbons in line 115 can range from a low of about 25° C., about 50° C., about 100° C., or about 150° C. to a high of about 200° C., about 250° C., about 350° C., about 450° C., or about 600° C. Heating the hydrocarbon within the one or more heaters 110 can vaporize at least a portion of the hydrocarbon, thereby increasing the pressure of the heated hydrocarbon in line 115 above the pressure of the hydrocarbon in line 105. The pressure of the heated hydrocarbon in line 115 can range from a low of about 100 kPa, about 300 kPa, about 450 kPa, or about 600 kPa to a high of about 1,000 kPa, about 2,000 kPa, about 2,500 kPa, or about 3,000 kPa.

The heater 110 can include any system, device, or combination of systems and/or devices suitable for increasing the temperature of the one or more hydrocarbons in line 105. Illustrative heat exchangers can include, but are not limited to shell-and-tube exchangers, plate and frame exchangers, spiral wound exchangers, or any combination thereof. In one or more embodiments, a heat transfer medium such as steam, hot oil, hot process fluids, electric resistance heat, hot waste fluids, or combinations thereof can be used to provide the necessary heat to the one or more hydrocarbons in line 105. In one or more embodiments, the one or more heat exchangers 110 can be a direct fired heater, for example a natural gas fired heater, or the equivalent.

The heat exchanger 110 can operate at a temperature ranging from a low of about 25° C., about 50° C., about 100° C., or about 150° C. to a high of about 200° C., about 250° C., about 350° C., about 450° C., or about 600° C. The heat exchanger 110 can operate at a pressure ranging from a low of about 100 kPa, about 500 kPa, or about 1,000 kPa to a high of about 2,000 kPa, about 2,500 kPa, or about 3,000 kPa.

The operating pressure of the flash separation unit 120 can be less than the pressure of the heated hydrocarbon introduced thereto via line 115. The reduced pressure within the flash separation unit 120 relative to the pressure of the hydrocarbon in line 115 can promote the volatilization ("flashing") of lighter hydrocarbons within the flash separation unit 120. The operating pressure of the flash separation unit 120 can range from a low of about 50 kPa, about 100 kPa, about 125 kPa, or about 150 kPa to a high of about 200 kPa, about 250 kPa, about 300 kPa, or about 350 kPa. The operating pressure of the flash separation unit 120 can be atmospheric pressure.

The vaporized hydrocarbon in line 125 can be a mixture containing one or more $C_1$ to $C_{20}$ hydrocarbon compounds. The vaporized hydrocarbons in line 125 can include one or more light naphthas and/or one or more heavy naphthas. The vaporized hydrocarbons in line 125 can be further processed, converted and/or fractionated to provide one or more products. The amount of vaporized hydrocarbons in line 125 can be about 0.1 wt %, about 0.3 wt %, about 0.5 wt %, about 0.75 wt %, about 0.9 wt %, or about 1 wt % of the total amount of hydrocarbons introduced to the one or more flash separation units 120. In one or more embodiments, the amount of vaporized hydrocarbons in line 125 can be about 1.5 wt %, about 2.5 wt %, about 3.5 wt %, about 4.5 wt %, or about 5.5 wt % of the total hydrocarbons introduced to the one or more flash separation units 120. For example, the amount of vaporized hydrocarbons in line 125 can range from about 0.5 wt % to about 6 wt %, from about 1.5 wt % to about 4.5 wt %, or from about 2.5 wt % to about 3.5 wt % of the total amount of hydrocarbons introduced to the one or more flash separation units 120. In one or more embodiments, more than 5 wt %, more than 10 wt %, more than 15 wt %, or more than 20 wt % of the total amount of hydrocarbons introduced via line 115 to the one or more flash separation units 120 can be recovered as vaporized hydrocarbons via line 125.

In one or more embodiments, the vaporized hydrocarbons in line 125 can include more than 0.5% mol $C_1$-$C_3$ hydrocarbons, more than 0.5% mol $C_4$-$C_6$ hydrocarbons, and more than 1% mol $C_7$-$C_9$ hydrocarbons. The $C_1$-$C_3$ hydrocarbons can range from a low of about 0.5% mol, about 1% mol, or about 1.5% mol to a high of about 3% mol, about 5% mol, or about 10% mol or more of the vaporized hydrocarbons in line 125. The $C_4$-$C_6$ hydrocarbons can range from a low of about 0.5% mol, about 1% mol, or about 1.5% mol to a high of about 3% mol, about 5% mol, or about 10% mol or more of the vaporized hydrocarbons in line 125. The $C_7$-$C_9$ hydrocarbons can range from a low of about 0.5% mol, about 1% mol, or about 1.5% mol to a high of about 3% mol, about 5% mol, or about 10% mol or more of the vaporized hydrocarbons in line 125.

As used herein, the term "light naphtha" can refer to a class of hydrocarbons rich in paraffinic hydrocarbons. In one or more embodiments, light naphthas can include hydrocarbons containing 6 or fewer carbon atoms ($C_6$ or less). Light naphthas generally include hydrocarbons having a normal boiling range extending from about 35° C. to about 80° C.

As used herein, the term "heavy naphtha" can refer to a class of hydrocarbons rich in paraffins, cycloparaffins, naphthenes, and aromatics. In one or more embodiments, heavy naphthas can include hydrocarbons containing between 7 and 12 carbon atoms ($C_7$-$C_{12}$). Heavy naphthas generally include hydrocarbons having a normal boiling range above the boiling range of light naphthas. Heavy naphthas can include hydrocarbons having normal boiling points from about 80° C. to about 210° C.

The residual hydrocarbons recovered via line 130 from the flash separation unit 120 can include, but are not limited to, $C_5$ and heavier hydrocarbons, asphaltenes, organo-metallic compounds, organo-sulfur compounds, mixtures thereof, derivatives thereof, or any combination thereof. The residual hydrocarbons in line 130 can have an asphaltenic hydrocarbon concentration ranging from a low of about 1 wt %, about 5 wt %, or about 10 wt % to a high of about 40 wt %, about 50 wt %, or about 60 wt %.

The one or more flash separation units 120 can include any system, device, or combination of systems and/or devices suitable for rapidly separating ("flashing") one or more, non-speciated, volatile, hydrocarbons from a hydrocarbon mixture to provide one or more volatile hydrocarbons via line 125 and one or more residual hydrocarbons via line 130. The one or more flash separation units 120 can contain one or more internal structures including, but not limited to bubble trays, packing elements such as rings or saddles, structured packing, or combinations thereof. The flash separation unit 120 can be an open column without internals. The one or more flash separation units 120 can be a partially empty column containing one or more internal structures. The one or more flash separation units 120 can operate at a temperature ranging from a low of about 25° C., about 50° C., about 100° C., or about 150° C. to a high of about 200° C., about 250° C., about 350° C., about 450° C., or about 600° C. The one or more flash separation units 120 can operate at a pressure ranging from a low of about 50 kPa, about 75 kPa, or about 100 kPa, to a high of about 200 kPa, about 500 kPa, or about 1,000 kPa. In one or more embodiments, the one or more flash separation units 120 can operate at atmospheric pressure.

All or a portion of the residual hydrocarbons in line 130 can be introduced via line 135 to the two-stage solvent deasphalting system 200. Within the two-stage solvent deasphalting system 200, the residual hydrocarbons in line 135 can be mixed with one or more solvents to agglomerate the asphaltenes, thereby providing an asphaltene/solvent mixture containing the asphaltenes introduced with the residual hydrocarbons in line 135. The temperature of the asphaltene/solvent mixture can be increased using one or more heaters. The asphaltenes can be separated from the asphaltene/solvent mixture within the two-stage solvent deasphalting system 200 to provide a deasphalted oil ("DAO") product via line 263 and an asphaltene product via line 233. In one or more embodiments, at least a portion of the solvent can be recovered with the DAO product in line 263 and/or the asphaltene product in line 233.

All or a portion of the residual hydrocarbons in line 130 can be introduced via line 140 to the three-stage solvent deasphalting system 300. Within the three-stage solvent deasphalting system 300, the residual hydrocarbons in line 140 can be mixed with one or more solvents to agglomerate the asphaltenes, thereby providing an asphaltene/solvent mixture containing the asphaltenes introduced with the residual hydrocarbons in line 140. The asphaltenes can be separated from the first mixture within the three-stage solvent deasphalting system 300 to provide a DAO product and an asphaltene product. The temperature of the DAO product can be increased to a third temperature using one or more heaters. The DAO product can be separated into a heavy deasphalted oil product ("H-DAO") that can be recovered via line 305, and a light deasphalted oil ("L-DAO") product that can be recovered via line 388. The asphaltene product can be recovered via line 333.

The asphaltene product via line 233 and/or 333 can be further processed to provide a refined asphaltene product. For example, at least a portion of the asphaltenes can be coked to provide one or more coked hydrocarbon products. The DAO product via line 263, the L-DAO product via line 388, and/or the H-DAO product via line 305 can be further processed to provide a refined DAO product. For example, the DAO in line 263, the L-DAO product in line 288, and/or the H-DAO product in line 305 can be hydroprocessed, which can include, but is not limited to hydrodesulfurization, hydrotreating, hydrocracking, hydrogenation, hydroisomerization, hydrodewaxing, metal removal, ammonia removal, and the like. The DAO in line 263 can be fractionated to provide one or more finished products that can include atmospheric gas oil and/or vacuum gas oil. Other processing units, such as fluid catalytic crackers ("FCC"), and delayed cokers can be used.

Figure 2:
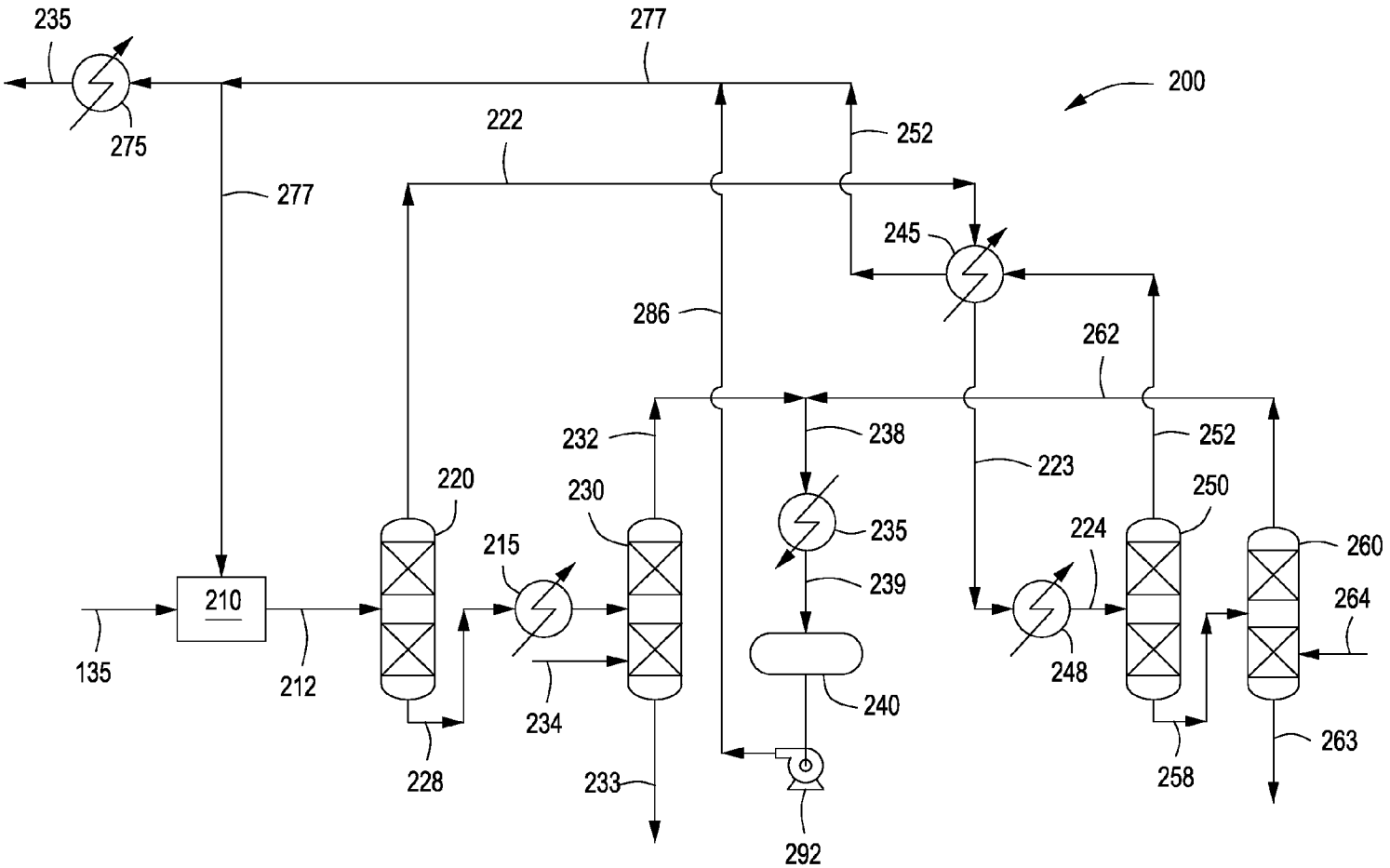
FIG. 2 depicts a schematic of an illustrative two-stage solvent extraction system according to one or more embodiments described.

FIG. 2 depicts a schematic of an illustrative two-stage solvent extraction system 200, according to one or more embodiments. The two-stage solvent extraction system 200 can include one or more mixers (one is shown) 210, separators 220, 250, and strippers 230, 260. Any number of mixers, separators, and strippers can be used depending on the volume of the hydrocarbon to be processed, desired processing rate, and the like. The residual hydrocarbon in line 135 and the one or more solvent(s) in line 277 can be mixed or otherwise combined within the one or more mixers 210 to provide a hydrocarbon mixture via line 212. The residual hydrocarbon in line 135 can be as discussed and described above with reference to FIG. 1. The solvent-to-hydrocarbon weight ratio can vary depending upon the physical properties and/or composition of the hydrocarbon in line 135. For example, a high boiling point hydrocarbon in line 135 can require greater dilution with one or more low boiling point solvents to obtain the desired bulk boiling point for the mixture. The hydrocarbon mixture in line 212 can have a solvent-to-hydrocarbon dilution ratio of from about 1:1 to about 100:1; about 2:1 to about 10:1; or about 3:1 to about 6:1.

The one or more mixers 210 can be any device, system, or combination of devices and/or systems suitable for batch, intermittent, and/or continuous mixing of the hydrocarbon and solvent. In one or more embodiments, the mixer 110 can be capable of homogenizing immiscible fluids. Illustrative mixers can include, but are not limited to, ejectors, inline static mixers, inline mechanical/power mixers, homogenizers, or combinations thereof. The mixer 110 can operate at a temperature ranging from a low of about 25° C., about 100° C., or about 200° C. to a high of about 300° C., about 450° C., or about 600° C. The mixer 210 can operate at a pressure slightly higher, for example about 50 kPa, about 100 kPa, or about 150 kPa, than the pressure of the separator 220. In one or more embodiments, the mixer 210 can operate at a pressure from about 101 kPa to about 700 kPa above the critical pressure of the solvent(s) ("$P_{C,S}$"), about $P_{C,S}$−700 kPa to about $P_{C,S}$+700 kPa, or about $P_{C,S}$−300 kPa to about $P_{C,S}$+300 kPa.

The hydrocarbon mixture in line 212 can be introduced to the one or more separators ("asphaltene separators") 220 to provide a DAO/solvent mixture via line 222 and an asphaltene/solvent mixture via line 228. The DAO/solvent mixture in line 222 can contain deasphalted oil and a first portion of the one or more solvent(s). The asphaltene/solvent mixture in line 228 can contain insoluble asphaltenes and the balance of the solvent. The DAO/solvent mixture in line 222 can have a DAO concentration ranging from a low of about 1 wt %, about 5 wt %, or about 15 wt % to a high of about 35 wt %, about 40 wt %, or about 50 wt %. The solvent concentration in line 222 can range from a low of about 50 wt %, about 60 wt %, or about 65 wt % to a high of about 80 wt %, about 90 wt %, or about 95 wt %. The API at 15.6° C. of the DAO/solvent mixture in line 222 can range from a low of about 10°, about 20°, about 30° C., about 40°, or about 50° to a high of about 80°, about 90° C., or about 100°.

The asphaltene/solvent mixture in line 228 can have an asphaltene concentration of from a low of about 10 wt %, about 30 wt %, or about 50 wt % to a high of about 90 wt %, about 95 wt %, or about 99 wt %. In one or more embodiments, the asphaltene/solvent mixture in line 228 can have a solvent concentration of from a low of about 1 wt %, about 5 wt %, or about 10 wt % to a high of about 50 wt %, about 70 wt %, or about 90 wt %.

The one or more separators 220 can be any system, device, or combination of systems and/or devices suitable for separating one or more asphaltenes from the hydrocarbon and solvent mixture to provide the DAO/solvent mixture via line 222 and asphaltene/solvent mixture via line 228. The one or more separators 220 can contain one or more internal structures including, but not limited to bubble trays, packing elements such as rings or saddles, structured packing, or combinations thereof. The one or more separators 220 can be an open column without internals. The one or more separators 220 can be one or more partially empty columns containing one or more internal structures. The one or more separators 220 can operate at a temperature of about 15° C. to about 150° C. above the critical temperature of the one or more solvent(s) ("$T_{C,S}$"); about 15° C. to about $T_{C,S}$+100° C., or about 15° C. to about $T_{C,S}$+50° C. The one or more separators 220 can operate at a pressure of about 101 kPa to about 700 kPa above the critical pressure of the solvent(s) ("$P_{C,S}$"); about $P_{C,S}$−700 kPa to about $P_{C,S}$+700 kPa, or about $P_{C,S}$−300 kPa to about $P_{C,S}$+300 kPa.

The asphaltene/solvent mixture in line 228 can be heated using one or more heat exchangers 215, prior to introduction to the one or more strippers 230. The asphaltene/solvent mixture in line 228 can be heated to a temperature of about 100° C. to about $T_{C,S}$+150° C., about 150° C. to about $T_{C,S}$+100° C., or about 300° C. to about $T_{C,S}$+50° C.

The one or more heat exchangers 215 can include any system, device, or combination of systems and/or devices suitable for increasing the temperature of the asphaltenes in line 228. Illustrative heat exchangers, systems or devices can include, but are not limited to shell-and-tube exchangers, plate and frame exchangers, spiral wound exchangers, or any combination thereof. A heating transfer medium such as steam, hot oil, hot process fluids, electric resistance heat, hot waste fluids, or combinations thereof can be used to transfer the necessary heat to the asphaltene/solvent mixture in line 228. The one or more heat exchangers 215 can be a direct fired heater or the equivalent. The one or more heat exchangers 215 can operate at a temperature of about 25° C. to about $T_{C,S}$+150° C., about 25° C. to about $T_{C,S}$+100° C., or about 25° C. to about $T_{C,S}$+50° C. The one or more heat exchangers 215 can operate at a pressure of about 100 kPa to about $P_{C,S}$+700 kPa, about 100 kPa to about $P_{C,S}$+500 kPa, or about 100 kPa to about $P_{C,S}$+300 kPa.

Within the stripper 230, the solvent in the asphaltene/solvent mixture in line 228 can be separated to provide a recovered solvent via line 232 and an asphaltene product via line 233. The recovered solvent in line 232 can contain a first portion of one or more solvents and small quantities of residual DAO, and the asphaltene product in line 233 can contain a mixture of insoluble asphaltenes and the balance of the one or more solvent(s). The recovered solvent in line 232 can have a solvent concentration ranging from a low of about 50 wt %, about 70 wt %, or about 85 wt % to a high of about 90 wt %, about 95 wt %, or about 99 wt %. The asphaltene product in line 233 can have an asphaltene concentration ranging from a low of about 20 wt %, about 40 wt %, or about 50 wt % to a high of about 75 wt %, about 85 wt %, or about 95 wt %.

The specific gravity (API at 15.6° C.) of the asphaltene product in line 233 can range from a low of about −10°, about −5°, or about 0° to a high of about 5°, about 10°, or about 15°.

At least a portion of the asphaltene product in line 233 can be dried and pelletized. At least a portion of the asphaltene product in line 233 can be gasified to provide one or more gas products for power generation, process heating, or combinations thereof. At least a portion of the asphaltene product in line 233 can be combusted to provide steam, mechanical power, electrical power or any combination thereof.

In one or more embodiments, saturated or superheated steam can be introduced to the one or more strippers 230 via line 234 to further enhance the separation of the one or more solvents from the asphaltene/solvent mixture introduced via line 228. The steam introduced via line 234 can be at a pressure ranging from a low of about 200 kPa, about 400 kPa, or about 600 kPa to a high of about 1,100 kPa, about 1,500 kPa, or about 2,500 kPa.

The one or more strippers 230 can include any system, device, or combination of systems and/or devices suitable for separating the asphaltenes in line 228 to provide the recovered solvent via line 232 and the asphaltene product in line 233. The one or more strippers 230 can contain one or more internal structures including, but not limited to bubble trays, packing elements such as rings or saddles, structured packing, or combinations thereof. The one or more strippers 230 can be an open column without internals. The one or more strippers 230 can be one or more partially empty columns containing one or more internal structures. The one or more strippers 230 can operate at a temperature ranging from a low of about 30° C., about 100° C., or about 300° C. to a high of about 400° C., about 500° C., or about 600° C. The one or more strippers 230 can operate at a pressure ranging from a low of about 100 kPa, about 500 kPa, or about 1,000 kPa to a high of about 2,500 kPa, about 3,250 kPa, or about 4,000 kPa.

The DAO/solvent mixture recovered via line 222 from the one or more asphaltene strippers 220 can be heated using one or more heat exchangers 245, 248 to provide a heated DAO mixture via line 224 at an elevated temperature. The temperature of the heated DAO/solvent mixture in line 224 can be increased above the critical temperature of the solvent(s) $T_{C,S}$. All or a portion of the solvent in line 252 can be used to increase the temperature of the DAO/solvent mixture in line 222 using the one or more heat exchangers 245. The heated DAO mixture in line 224 can be at a temperature of from about 25° C. to about $T_{C,S}$+150° C., about $T_{C,S}$−100° C. to about $T_{C,S}$+100° C., or about $T_{C,S}$−50° C. to about $T_{C,S}$+50° C.

The one or more heat exchangers 245, 248 can include any system, device, or combination of systems and/or devices suitable for increasing the temperature of the DAO/solvent mixture in line 222. The heat exchanger 245 can be a regenerative type heat exchanger using a high temperature process stream to heat the DAO mixture in line 222 prior to introduction to the separator 250. The one or more heat exchangers 245, 248 can operate at a pressure of about 100 kPa to about $P_{C,S}$+700 kPa, about 100 kPa to about $P_{C,S}$+500 kPa, or about 100 kPa to about $P_{C,S}$+300 kPa The heated DAO mixture in line 224 can be introduced into the one or more separators 250 and separated therein to provide a solvent-rich overhead via line 252 and a DAO-rich bottoms via line 258. The solvent-rich overhead in line 252 can contain a first portion of the one or more solvent(s), and the bottoms in line 258 can contain DAO and the balance of the one or more solvent(s). The solvent-rich overhead in line 252 can have a solvent concentration ranging form a low of about 50 wt %, about 70 wt %, or about 85 wt % to a high of about 90 wt %, about 95 wt %, or about 99 wt %. The DAO-rich bottoms in line 258 can have a DAO concentration ranging from a low of about 40 wt %, about 50 wt %, or about 60 wt % to a high of about 75 wt %, about 85 wt %, or about 95 wt %. The DAO-rich bottoms in line 258 can have a specific gravity (API at 15.6° C.) ranging from a low of about 5° API, about 10° API, or about 15° API to a high of about 20° API, about 25° API, or about 30° API.

The one or more separators 250 can include any system, device, or combination of systems and/or devices suitable for separating the DAO mixture introduced via line 224 into the solvent-rich overhead in line 252 and the DAO-rich bottoms in line 258. The one or more separators 250 can contain one or more internal structures including, but not limited to bubble trays, packing elements such as rings or saddles, structured packing, or combinations thereof. The one or more separators 250 can be an open column without internals. The one or more separators 250 can be one or more partially empty columns containing one or more internal structures. The one or more separators 250 can operate at a temperature ranging from a low of about 25° C., about 50° C., or about 100° C. to a high of about 400° C., about 500° C., or about 600° C. The one or more separators 250 can operate at a pressure of about 101 kPa to about 700 kPa above the critical pressure of the solvent(s), about $P_{C,S}$−700 kPa to about $P_{C,S}$+700 kPa, or about $P_{C,S}$−300 kPa to about $P_{C,S}$+300 kPa.

At least a portion of the DAO-rich bottoms in line 258 can be introduced to the one or more strippers 260 and separated therein to provide a recovered solvent via line 262 and DAO product via line 263. The recovered solvent in line 262 can contain a first portion of the one or more solvents, and the DAO product in line 263 can contain DAO and the balance of the one or more solvents. The recovered solvent in line 262 can have a solvent concentration ranging from a low of about 70 wt %, about 85 wt %, or about 90 wt % to a high of about 95 wt %, about 99 wt %, or about 99.9 wt %. The DAO product in line 263 can have a DAO concentration ranging from a low of about 40 wt %, about 50 wt %, or about 60 wt % to a high of about 85 wt %, about 95 wt %, or about 99 wt %. The specific gravity (at 15.6° C.) of the DAO product in line 263 can range from a low of about 5° API, about 10° API, or about 15° API to a high of about 20° API, about 25° API, or about 30° API.

Steam can be introduced via line 264 to the stripper 260 to enhance the separation of the one or more solvents from the DAO. The steam added via line 264 can be saturated or superheated. The steam in line 264 can be at a pressure ranging from a low of about 200 kPa, about 500 kPa, or about 1,000 kPa to a high of about 1,200 kPa, about 1,500 kPa, or about 2,200 kPa.

The one or more strippers 260 can include any system, device, or combination of systems and/or devices suitable for separating DAO mixture in line 258 to provide the recovered solvent via line 262 and the DAO product via line 263. The one or more strippers 260 can contain one or more internal structures including, but not limited to bubble trays, packing elements such as rings or saddles, structured packing, or combinations thereof. The one or more strippers 260 can be an open column without internals. The one or more strippers 260 can be one or more partially empty columns containing one or more internal structures. The one or more strippers 260 can operate at a temperature ranging from a low of about 25° C., about 100° C., or about 200° C. to a high of about 400° C., about 500° C., or about 600° C. The pressure in the one or more strippers 260 can range from a low of about 100 kPa, about 500 kPa, or about 1,000 kPa to a high of about 2,500 kPa, about 3,300 kPa, or about 4,000 kPa.

At least a portion of the recovered solvent in line 262 and the recovered solvent in line 232 can be combined to provide a combined solvent via line 238. The combined solvent in line 238 can be a two phase mixture having both liquid and vapor phases. The temperature of the combined solvent in line 238 can range from a low of about 30° C., about 150° C., or about 300° C. to a high of about 400° C., about 500° C., or about 600° C.

All or a portion of the combined solvent in line 238 can be condensed using the one or more condensers 235 to provide a cooled solvent in line 239. The cooled solvent in line 239 can have a temperature ranging from a low of about 10° C., about 20° C., or about 30° C. to a high of about 100° C., about 200° C., or about 400° C. The solvent concentration in line 239 can range from a low of about 80 wt %, about 85 wt %, or about 90 wt % to a high of about 95 wt %, about 99 wt %, or about 99.9 wt % or more.

The one or more condensers 235 can include any system, device, or combination of systems and/or devices suitable for decreasing the temperature of the recycled solvents in line 238 to provide a condensed solvent via line 239. The condenser 235 can include, but is not limited to liquid or air cooled shell-and-tube, plate and frame, fin-fan, or spiral wound cooler designs. A cooling medium such as water, refrigerant, air, or combinations thereof can be used to remove the necessary heat from the recycled solvents in line 238. The one or more condensers 235 can operate at a temperature of about −20° C. to about $T_{C,S}$° C., about −10° C. to about 300° C., or about 0° C. to about 300° C. The one or more condensers 235 can operate at a pressure of about 100 kPa to about $P_{C,S}$+700 kPa, or about 100 kPa to about $P_{C,S}$+500 kPa, or about 100 kPa to about $P_{C,S}$+300 kPa.

At least a portion of the condensed solvent in line 239 can be stored or otherwise accumulated in the one or more reservoirs 240. At least a portion of the solvent in the one or more reservoirs 240 can be recycled via line 286 using one or more pumps 292. The recycled solvent in line 286 can be combined with at least a portion of the solvent overhead in line 252 to provide a solvent recycle via line 277. A first portion of the recycled solvent in line 277 can be recycled to the mixer 210 in the solvent deasphalting process 200.

A second portion of the solvent in line 277 can be recycled via line 235 to one or more systems, for example an up-stream solvent dewatering system (not shown). The temperature of the recycled solvent in line 235 can be adjusted by passing the appropriate heating or cooling medium through one or more heat exchangers 275. The solvent in line 235 can have a temperature ranging from a low of about 10° C., about 100° C., or about 200° C. to a high of about 200° C., about 300° C., or about 400° C. The solvent in line 235 can have a solvent concentration ranging from a low of about 80 wt %, about 85 wt %, or about 90 wt % to a high of about 95 wt %, about 99 wt %, or about 99.9 wt %.

The one or more heat exchangers 275 can include, but are not limited to one or more liquid or air cooled shell-and-tube, plate and frame, fin-fan, or spiral wound exchanger designs. The one or more heat exchangers 275 can operate at a temperature ranging from about −20° C. to about $T_{C,S}$° C., about −10° C. to about 300° C., or about 0° C. to about 300° C. The one or more condensers 235 can operate at a pressure of about 100 kPa to about $P_{C,S}$+700 kPa, or about 100 kPa to about $P_{C,S}$+500 kPa, or about 100 kPa to about $P_{C,S}$+300 kPa.

Figure 3:
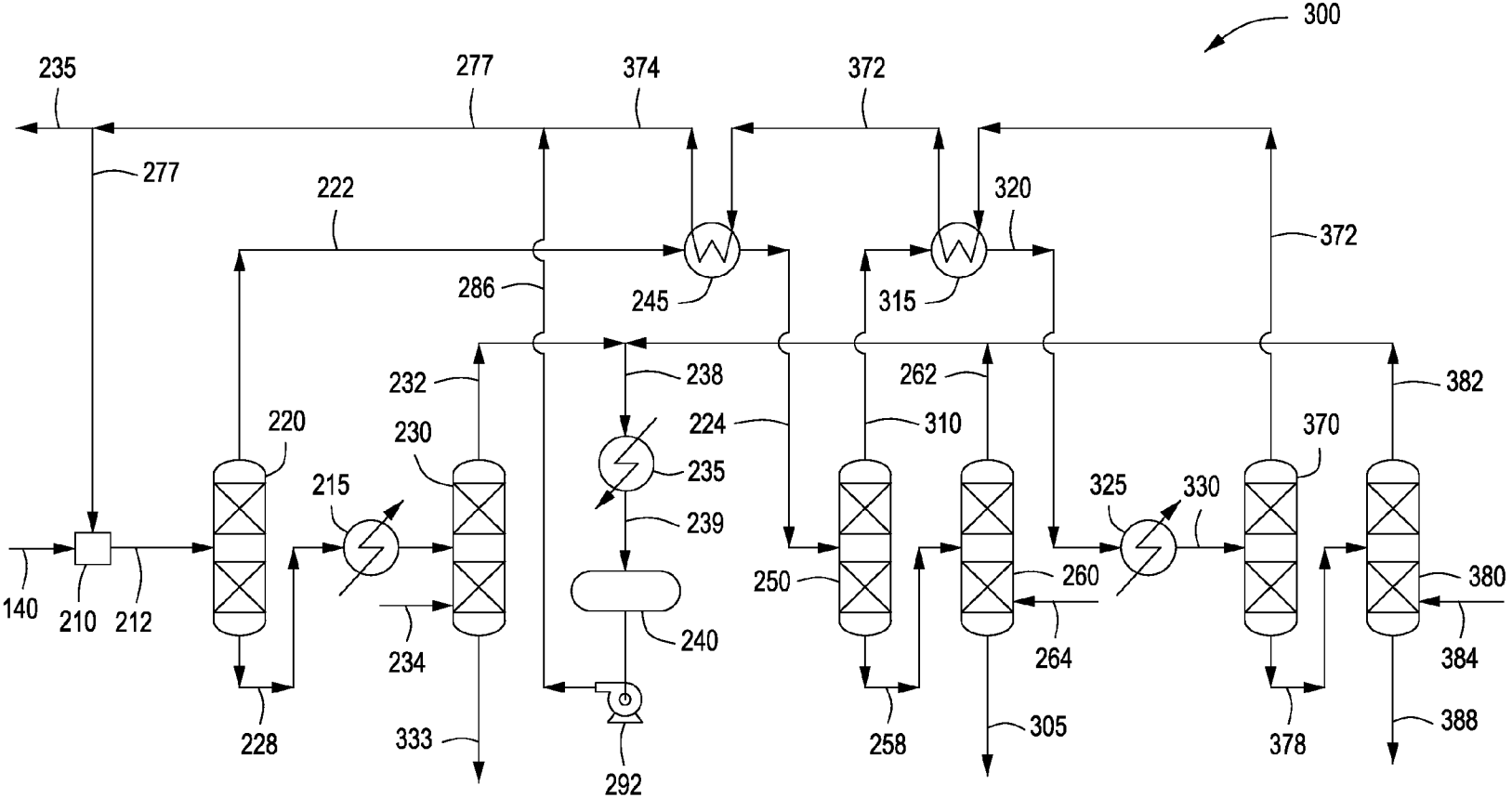
FIG. 3 depicts a schematic of an illustrative three-stage solvent extraction system according to one or more embodiments described.

FIG. 3 depicts a schematic of an illustrative three-stage solvent extraction system 300 according to one or more embodiments. In addition to the system 200 shown and described above with reference to FIG. 2, the three-stage solvent extraction system 300 can further include one or more separators 370 and strippers 380 to separate the DAO/solvent mixture in line 222 into a heavy deasphalted oil ("H-DAO") product via line 305 and a light deasphalted oil ("L-DAO") product via line 388. As discussed and described above with reference to FIGS. 1 and 2 an asphaltene product can be recovered via line 333.

The terms "light deasphalted oil" and "L-DAO" as used herein can refer to a solution or mixture containing one or more hydrocarbons sharing similar physical properties and containing less than about 5 wt %, less than about 4 wt %, less than about 3 wt %, less than about 2 wt %, or less than about 1% asphaltenic hydrocarbons. The L-DAO can have a boiling point of about 250° C. to about 750° C.; about 275° C. to about 670° C.; or about 315° C. to about 610° C. The L-DAO can have a viscosity (at 50° C.) of about 30 cSt to about 75 cSt; about 35 cSt to about 70 cSt; or about 40 cSt to about 65 cSt. The L-DAO can have a flash point greater than about 110° C.; greater than about 115° C.; greater than about 120° C.; or greater than about 130° C. For example, The L-DAO can have a flash point ranging from about 105° C. to about 150° C., about 110° C. to about 140° C., or about 110° C. to about 130° C.

The terms "heavy deasphalted oil" and "H-DAO" as used herein can refer to a mixture containing one or more hydrocarbons sharing similar physical properties and containing less than about 5 wt %, less than about 4 wt %, less than about 3 wt %, less than about 2 wt %, or less than about 1% asphaltenic hydrocarbons. The H-DAO can have a boiling point ranging from a low of about 300° C., about 350° C., or about 400° C. to a high of about 800° C., about 850° C., or about 900° C. The H-DAO can have a viscosity (at 50° C.) of about 40 cSt to about 190 cSt, about 45 cSt to about 180 cSt, or about 50 cSt to about 170 cSt. The H-DAO can have a flash point of greater than about 135° C., greater than about 140° C., greater than about 145° C., or greater than about 150° C.

The terms "deasphalted oil" and "DAO" as used herein can refer to a hydrocarbon mixture containing both light deasphalted and heavy deasphalted oils in any concentration and/or quantity.

The temperature of the first product in line 222 can be increased using one or more heat exchangers 245 to provide a heated deasphalted oil at a third temperature in line 224. The temperature of the heated deasphalted oil in line 224 can be less than the critical temperature ("$T_{C,S}$") of the one or more solvents introduced via line 277 to the incoming hydrocarbons. The temperature of the heated deasphalted oil in line 224 can be at or above the critical temperature of the one or more solvents introduced via line 277 to the incoming hydrocarbons.

The temperature of the DAO/solvent mixture in line 224 can be at or above the critical temperature of the solvent using the one or more heaters 245. Increasing the temperature of the DAO/solvent mixture in line 222 above the critical temperature of the solvent can promote the separation of DAO into two phases, a phase ("first phase") containing L-DAO and a first portion of the one or more solvents and a phase ("second phase") containing H-DAO and a balance of the one or more solvents. The temperature of the DAO/solvent mixture in line 224 can range from about 15° C. to about $T_{C,S}$+150° C., about 15° C. to about $T_{C,S}$+100° C., or about 15° C. to about $T_{C,S}$+50° C.

The DAO/solvent mixture in line 224 can be and introduced to the one or more separators 250 wherein the first and second phases can be separated, providing the first phase via line 310 containing the L-DAO fraction and at least a portion of the one or more solvents, and the second phase via line 258 containing the H-DAO fraction and the balance of the one or more solvents.

The first phase in line 310 can have an L-DAO concentration ranging from a low of about 1 wt %, about 10 wt %, or about 20 wt % to a high of about 30 wt %, about 40 wt %, or about 50 wt %. The first phase in line 310 can have a solvent concentration ranging from a low of about 50 wt %, about 60 wt %, or about 70 wt % to a high of about 90 wt %, about 95 wt %, or about 99 wt %. or more. The first phase in line 310 can have a maximum H-DAO concentration of about 20 wt % or less, about 15 wt % or less, about 10 wt % or less, about 5 wt % or less, or about 1 wt % or less.

The second phase in line 258 can have an H-DAO concentration ranging from a low of about 10 wt %, about 20 wt %, or about 40 wt % to a high of about 60 wt %, about 80 wt %, or about 90 wt % or more. The second phase in line 258 can have a solvent concentration ranging from a low of about 10 wt %, about 20 wt %, or about 30 wt % to a high of about 60 wt %, about 80 wt %, or about 90 wt %. The second phase in line 258 can have a maximum L-DAO concentration of about 20 wt % or less, about 15 wt % or less, about 10 wt % or less, about 5 wt % or less, or about 1 wt % or less.

The one or more separators 250 can include any system, device, or combination of systems and/or devices suitable for separating the heated DAO in line 224 to provide the first phase, containing L-DAO, via line 310 and the second phase, containing H-DAO, via line 258. The one or more separators 250 can contain one or more internal structures including, but not limited to bubble trays, packing elements such as rings or saddles, structured packing, or combinations thereof. The one or more separators 250 can be an open column without internals. The one or more separators 250 can be one or more partially empty columns containing one or more internal structures. The one or more separators 250 can be a partially or completely open column without internals. The one or more separators 250 can have an operating temperature of from about 15° C. to about $T_{C,S}$+150° C., about 15° C. to about $T_{C,S}$+100° C., or about 15° C. to about $T_{C,S}$+50° C. In one or more embodiments, the one or more separators 250 can have an operating pressure of from about 100 kPa to about $P_{C,S}$+700 kPa, about $P_{C,S}$−700 kPa to about $P_{C,S}$+700 kPa, or about $P_{C,S}$−300 kPa to about $P_{C,S}$+300 kPa.

The second phase in line 258 can be introduced into the one or more strippers 260 and separated therein to provide a recovered solvent ("second recovered solvent") via line 262 and an H-DAO product via line 305. Saturated or superheated steam can be introduced via line 264 to the stripper 260 to enhance the separation of the solvent and H-DAO. The recovered solvent in line 262 can have a solvent concentration ranging from a low of about 50 wt %, about 70 wt %, or about 85 wt % to a high of about 90 wt %, about 95 wt %, or about 99 wt % or more. The H-DAO product in line 305 can have an H-DAO concentration ranging from a low of about 20 wt %, about 40 wt %, or about 60 wt % to a high of about 75 wt %, about 90 wt %, or about 95 wt % or more. The specific gravity (API at 15.6° C.) of the H-DAO product in line 305 can range from a low of about 5° API, about 10° API, or about 15° API to a high of about 20° API, about 25° API, or about 30° API.

All or a portion of the H-DAO product in line 305 can be upgraded, converted, and/or fractionated using one or more processes to provide one or more fungible products. For example, at least a portion of the H-DAO product in line 305 can be introduced to one or more hydrotreaters, one or more thermal crackers, one or more fluid catalytic crackers, or any combination thereof for upgrading.

The one or more strippers 260 can include any system, device, or combination of systems and/or devices suitable for separating the second phase in line 258 to provide the recovered solvent in line 262 and the H-DAO product in line 305. The one or more strippers 260 can contain one or more internal structures including, but not limited to bubble trays, packing elements such as rings or saddles, structured packing, or combinations thereof. The one or more strippers 260 can be an open column without internals. The one or more strippers 260 can be one or more partially empty columns containing one or more internal structures. The one or more strippers 260 can be a partially or completely open column without internals. The one or more strippers 260 can have an operating temperature ranging from a low of about 15° C., about 100° C., or about 200° C. to a high of about 400° C., about 500° C., or about 600° C. The one or more strippers 260 can have an operating pressure ranging from a low of about 100 kPa, about 500 kPa, or about 1,000 kPa to a high of about 2,500 kPa, about 3,500 kPa, or about 4,000 kPa.

Returning to the one or more separators 250, in one or more embodiments, the temperature of the first phase in line 310 can be increased using one or more heat exchangers (two are shown 315, 325) to provide a heated first phase via line 330. The heated first phase in line 330 can be at a temperature of from about 15° C. to about $T_{C,S}$+150° C., about 15° C. to about $T_{C,S}$+100° C., or about 15° C. to about $T_{C,S}$+50° C.

The one or more heat exchangers 315 and 325 can have an operating temperature of from about 15° C. to about $T_{C,S}$+150° C., about 15° C. to about $T_{C,S}$+100° C., or about 15° C. to about $T_{C,S}$+50° C. The one or more heat exchangers 315 and 325 can have an operating pressure of from about 100 kPa to about $P_{C,S}$+700 kPa, about 100 kPa to about $P_{C,S}$+500 kPa, or about 100 kPa to about $P_{C,S}$+300 kPa.

The heated first phase in line 330 can be introduced to the one or more separators 370 and separated therein to provide a solvent-rich overhead via line 372 and an L-DAO rich bottoms via line 378. The solvent-rich overhead in line 372 can have a solvent concentration of from about 50 wt % to about 100 wt %, about 70 wt % to about 99 wt %, or about 85 wt % to about 99 wt %, with the balance L-DAO. The L-DAO rich bottoms via line 378 can have an L-DAO concentration of from about 10 wt % to about 90 wt %, about 25 wt % to about 80 wt %, or about 40 wt % to about 70 wt %, with the balance the one or more solvents. The solvent-rich overhead in line 372 can be cooled by passing the solvent-rich overhead in line 372 through one or more heat exchangers 315, 245 to provide a cooled solvent-rich overhead via line 374.

The one or more separators 370 can include any system, device, or combination of systems and/or devices suitable for separating the heated first phase in line 330 to provide the solvent-rich overhead via line 372 and the L-DAO rich bottoms via line 378. The one or more separators 370 can contain one or more internal structures including, but not limited to bubble trays, packing elements such as rings or saddles, structured packing, or combinations thereof. The one or more separators 370 can be an open column without internals. The one or more separators 370 can be one or more partially empty columns containing one or more internal structures. The one or more separators 370 can be a partially or completely open column without internals. The one or more separators 370 can have an operating temperature of from about 15° C. to about $T_{C,S}$+150° C., about 15° C. to about $T_{C,S}$+150° C., or about 15° C. to about $T_{C,S}$+50° C. The one or more separators 370 can have an operating pressure of from about 100 kPa to about $P_{C,S}$+700 kPa, about $P_{C,S}$−700 kPa to about $P_{C,S}$+700 kPa, or about $P_{C,S}$−300 kPa to about $P_{C,S}$+300 kPa.

The L-DAO rich bottoms via line 378 can be introduced into the one or more strippers 380 and separated therein to provide a recovered solvent via line 382 and a L-DAO product via line 388. Saturated and/or superheated steam can be introduced via line 384 to the stripper 380 to enhance the separation of the one or more solvents from the L-DAO. The recovered solvent in line 382 can have a solvent concentration of from ranging from a low of about 50 wt %, about 70 wt %, or about 85 wt % to a high of about 90 wt %, about 95 wt %, or about 99 wt % or more. The L-DAO product in line 388 can have an L-DAO concentration ranging from a low of about 20 wt %, about 40 wt %, or about 60 wt % to a high of about 95 wt %, about 90 wt %, or about 95 wt % or more. The L-DAO product in line 388 can have an L-DAO concentration of about 99% or more. The specific gravity (API at 15.6° C.) of the L-DAO product in line 388 can range from a low of about 5°, about 10°, or about 15° to a high of about 30°, about 40°, or about 60°.

The one or more strippers 380 can include any system, device, or combination of systems and/or devices suitable for separating the L-DAO rich bottoms in line 378 to provide the third recovered solvent via line 382 and the light deasphalted oil product via line 388. The one or more strippers 380 can contain one or more internal structures including, but not limited to bubble trays, packing elements such as rings or saddles, structured packing, or combinations thereof. The one or more strippers 380 can be an open column without internals. The one or more strippers 380 can be one or more partially empty columns containing one or more internal structures. The one or more strippers 380 can be a partially or completely open column without internals. The one or more strippers 380 can have an operating temperature of from about 15° C. to about $T_{C,S}$+150° C., about 15° C. to about $T_{C,S}$+150° C., or about 15° C. to about $T_{C,S}$+50° C. The one or more strippers 380 can have an operating pressure of from about 100 kPa to about $P_{C,S}$+700 kPa, about $P_{C,S}$−700 kPa to about $P_{C,S}$+700 kPa, or about $P_{C,S}$−300 kPa to about $P_{C,S}$+300 kPa.

At least a portion of the recovered solvent in line 232, the recovered solvent inline 262 and the recovered solvent in line 382 can be combined to provide a combined recovered solvent via line 238. The combined recovered solvent in line 238 can be a two phase liquid/vapor mixture. The combined recovered solvent in line 238 can have a temperature ranging from a low of about 30° C., about 100° C., or about 300° C. to a high of about 400° C., about 500° C., or about 600° C.

All or a portion of the combined recovered solvent in line 238 can be partially or completely condensed using one or more condensers 235 to provide a condensed solvent via line 239. The condensed solvent in line 239 can have a temperature ranging from a low of about 10° C., about 25° C., or about 40° C. to a high of about 100° C., about 200° C., or about 400° C. The condensed solvent in line 239 can have a solvent concentration ranging from a low of about 80 wt %, about 85 wt %, or about 90 wt % to a high of about 95 wt %, about 99 wt %, or about 99.9 wt % or more.

The one or more condensers 235 can include any system, device, or combination of systems and/or devices suitable for decreasing the temperature of the solvent in line 238. The condenser 235 can include, but is not limited to liquid or air cooled shell-and-tube, plate and frame, fin-fan, or spiral wound cooler designs. A cooling medium such as water, refrigerant, air, or combinations thereof can be used to remove the necessary heat from the solvent in line 238. The one or more condensers 235 can have an operating temperature of from about −20° C. to about $T_{C,S}$° C., about −10° C. to about 200° C., or about 0° C. to about 300° C. The one or more coolers 275 can have an operating pressure of from about 100 kPa to about $P_{C,S}$+700 kPa, about 100 kPa to about $P_{C,S}$+500 kPa, or about 100 kPa to about $P_{C,S}$+300 kPa.

The condensed solvent in line 239 can be stored or otherwise accumulated in one or more reservoirs 240. The solvent in the reservoir 240 can be transferred using one or more solvent pumps 292 and recycle lines 286. Recycling at least a portion of the solvent to the solvent deasphalting process 300 can decrease the quantity of fresh solvent make-up required.

Referring again to the one or more separators 370, in one or more embodiments, at least a portion of the solvent-rich overhead via line 372 can be cooled using one or more heat exchangers 315 and 245 to provide a cooled solvent-rich overhead via line 374. In one or more embodiments, about 1 wt % to about 95 wt %, about 5 wt % to about 55 wt %, or about 1 wt % to about 25 wt % of overhead in line 372 can be cooled using one or more heat exchangers 245 and 315. The solvent in line 374 can be at a temperature of from about 25° C. to about 400° C., about 50° C. to about 300° C., or about 100° C. to about 250° C. At least a portion of the cooled solvent-rich overhead in line 374 can be combined with at least a portion of the recycled solvent in line 286 for recycle to the one or more mixers 210 via line 277. All or a portion of the solvent in line 277 can be introduced to one or more external systems via line 235.

Embodiments of the present disclosure further relate to any one or more of the following numbered paragraphs 1 through 20:

1. A method for deasphalting a hydrocarbon, comprising heating a hydrocarbon to a first temperature; pressurizing the hydrocarbon to a first pressure; depressurizing the pressurized hydrocarbon to separate at least a portion of the hydrocarbon to provide a vaporized hydrocarbon mixture and a residual hydrocarbon comprising one or more asphaltenes; mixing the residual hydrocarbon with a solvent to provide a first mixture; heating the first mixture to a second temperature; and separating the asphaltenes from the first mixture to provide a first product comprising a deasphalted oil and at least a portion of the solvent and a second product comprising the asphaltenes and the remaining portion of the solvent.

2. The method of claim 1, wherein the first temperature is about 50° C. or more and the first pressure is about 300 kPa or more.

3. The method of claim 1, wherein the first temperature is about 100° C. or more and the first pressure is about 600 kPa or more.

4. The method of claim 1, wherein the vaporized hydrocarbon mixture comprises about 0.5 wt % or more of the hydrocarbon.

5. The method of claim 1, further comprising separating at least a portion of the solvent from the first product to provide a deasphalted oil product comprising less than about 5 wt % solvent and a solvent product.

6. The method of claim 1, further comprising separating at least a portion of the solvent from the second product to provide an asphaltene product comprising less than about 5 wt % solvent and a solvent product.

7. The method of claim 1 further comprising separating at least a portion of the solvent from the first product to provide deasphalted oil and a first recovered solvent; separating at least a portion of the solvent from the second product to provide one or more asphaltenes and a second recovered solvent; combining the first recovered solvent and second recovered solvent to provide a combined recovered solvent; condensing at least a portion of the combined recovered solvent; and recycling at least a portion of the condensed combined recovered solvent to provide at least a portion of the solvent mixed with the residual hydrocarbon.

8. The method of claim 1, wherein the second temperature is greater than or equal to the supercritical temperature of the solvent.

9. The method of claim 1 further comprising heating the first product to a third temperature; separating the heated first product to provide a light deasphalted mixture comprising light deasphalted oil and at least a portion of the solvent and a heavy deasphalted mixture comprising heave deasphalted oil and the remaining portion of the solvent; separating the light deasphalted mixture to provide a light deasphalted oil product and a first recovered solvent; separating the heavy deasphalted mixture to provide a heavy deasphalted oil and second recovered solvent; condensing at least a portion of the first recovered solvent, the second recovered solvent, or both to provide a condensed solvent; and recycling at least a portion of the condensed solvent to provide at least a portion of the solvent mixed with the residual hydrocarbon.

10. The method of claim 9 wherein the third temperature is equal to or greater than the supercritical temperature of the solvent.

11. A method for deasphalting a hydrocarbon comprising heating a hydrocarbon to a temperature of about 50° C. or more; pressurizing the hydrocarbon to a pressure of about 300 kPa or more; reducing the pressure of the pressurized hydrocarbon to separate at least a portion of the hydrocarbon to provide a vaporized hydrocarbon mixture and a residual hydrocarbon comprising asphaltenes and non-vaporized hydrocarbon; mixing the residual hydrocarbon with a solvent to provide a first mixture; heating the first mixture to a second temperature; and separating the agglomerated asphaltenes from the first mixture to provide a first product comprising the non-vaporized hydrocarbon and at least a portion of the solvent and a second product comprising the asphaltenes and the remaining portion of the solvent.

12. The method of claim 11, wherein the vaporized hydrocarbon mixture comprises about 0.5 wt % or more of the hydrocarbon.

13. The method of claim 11, further comprising separating at least a portion of the solvent from the first product to provide deasphalted oil and a first recovered solvent; separating at least a portion of the solvent from the second product to provide asphaltenes and a second recovered solvent; combining at least a portion of the first recovered solvent and the second recovered solvent to provide a combined recovered solvent; condensing at least a portion of the combined recovered solvent to provide a condensed solvent; and recycling at least a portion of the condensed solvent to provide at least a portion of the solvent mixed with the residual hydrocarbon.

14. The method of claim 11, wherein the second temperature is equal to or greater than the supercritical temperature of the solvent.

15. The method of claim 11, wherein the pressure of the pressurized hydrocarbon is reduced to about atmospheric pressure.

16. A system for deasphalting a hydrocarbon comprising: a means for pressurizing a hydrocarbon mixture to a first pressure; a means for heating the pressurized hydrocarbon to a first temperature; a means for depressurizing the pressurized hydrocarbon to separate at least a portion of the hydrocarbon to provide a vaporized hydrocarbon mixture and a residual hydrocarbon comprising asphaltenes; a means for mixing the residual hydrocarbon with a solvent to provide a first mixture; a means for heating the first mixture to a second temperature; and a means for separating the agglomerated asphaltenes from the first mixture to provide a first product comprising deasphalted oil and a at least a portion of the solvent and a second product comprising asphaltenes and the remaining portion of the solvent.

17. The system of claim 16, further comprising a means for separating at least a portion of the solvent from the first product to provide deasphalted oil and a first recovered solvent; a means for separating at least a portion of the solvent from the second product to provide asphaltenes and a second recovered solvent; a means for condensing at least a portion of the first recovered solvent, the second recovered solvent, or both to provide a condensed solvent; and a means for recycling at least a portion of the condensed solvent to provide at least a portion of the solvent mixed with the residual hydrocarbon.

18. The system of claim 16, wherein the second temperature is greater than or equal to the supercritical temperature of the one or more solvents.

19. The system of claim 16, wherein the first temperature is about 50° C. or more and the first pressure is about 300 kPa or more.

20. The method of claim 16, wherein the vaporized hydrocarbon mixture comprises about 0.5 wt % or more of the hydrocarbon.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for deasphalting a hydrocarbon comprising:

heating a hydrocarbon comprising about 100 ppmw to about 1,000 ppmw heavy metals to a first temperature of about 50° C. to about 600° C.;

pressurizing the hydrocarbon comprising about 100 ppmw to about 1,000 ppmw heavy metals to a first pressure of about 300 kPa to about 3,000 kPa;

depressurizing the pressurized hydrocarbon comprising about 100 ppmw to about 1,000 ppmw heavy metals to separate at least a portion of the hydrocarbon to provide a vaporized hydrocarbon mixture and a residual hydrocarbon comprising one or more asphaltenes;

mixing the residual hydrocarbon with a solvent to provide a first mixture;

heating the first mixture to a second temperature; and separating the asphaltenes from the first mixture to provide a first product comprising a deasphalted oil and at least a portion of the solvent and a second product comprising the asphaltenes and the remaining portion of the solvent.

2. The method of claim 1, wherein the first temperature is about 100° C. to about 600° C. and the first pressure is about 600 kPa to about 2,000 kPa.

3. The method of claim 1, wherein the vaporized hydrocarbon mixture comprises about 0.5 wt % to about 6 wt % of the hydrocarbon.

4. The method of claim 1, further comprising separating at least a portion of the solvent from the first product to provide a deasphalted oil product comprising less than about 5 wt % solvent and a solvent product.

5. The method of claim 1, further comprising separating at least a portion of the solvent from the second product to provide an asphaltene product comprising less than about 5 wt % solvent and a solvent product.

6. The method of claim 1 further comprising:

separating at least a portion of the solvent from the first product to provide deasphalted oil and a first recovered solvent;

separating at least a portion of the solvent from the second product to provide one or more asphaltenes and a second recovered solvent;

combining the first recovered solvent and second recovered solvent to provide a combined recovered solvent;

condensing at least a portion of the combined recovered solvent; and recycling at least a portion of the condensed combined recovered solvent to provide at least a portion of the solvent mixed with the residual hydrocarbon.

7. The method of claim 1, wherein the second temperature is greater than or equal to the supercritical temperature of the solvent.

8. The method of claim 1 further comprising:

heating the first product to a third temperature;

separating the heated first product to provide a light deasphalted mixture comprising light deasphalted oil and at least a portion of the solvent and a heavy deasphalted mixture comprising heave deasphalted oil and the remaining portion of the solvent;

separating the light deasphalted mixture to provide a light deasphalted oil product and a first recovered solvent;

separating the heavy deasphalted mixture to provide a heavy deasphalted oil and second recovered solvent;

condensing at least a portion of the first recovered solvent, the second recovered solvent, or both to provide a condensed solvent; and recycling at least a portion of the condensed solvent to provide at least a portion of the solvent mixed with the residual hydrocarbon.

9. The method of claim 8 wherein the third temperature is equal to or greater than the supercritical temperature of the solvent.

10. The method of claim 1, wherein the heavy metals comprise nickel, vanadium, or mixtures thereof, and wherein the pressurized hydrocarbon further comprises about 2 wt % to about 6 wt % sulfur, about 10 wt % to about 30 wt % asphaltenes, and about 1 wt % to about 30 wt % bitumen.

11. The method of claim 1, wherein the hydrocarbon comprises untreated hydrocarbons obtained from a subterranean formation.

12. A method for deasphalting a hydrocarbon comprising:

heating a hydrocarbon comprising about 100 ppmw to about 1,000 ppmw heavy metals to a temperature of about 50° C. to about 600° C.;

pressurizing the hydrocarbon comprising about 100 ppmw to about 1,000 ppmw heavy metals to a pressure of about 300 kPa to about 3,000 kPa;

reducing the pressure of the pressurized hydrocarbon comprising about 100 ppmw to about 1,000 ppmw heavy metals to separate at least a portion of the hydrocarbon to provide a vaporized hydrocarbon mixture and a residual hydrocarbon comprising asphaltenes and non-vaporized hydrocarbon;

mixing the residual hydrocarbon with a solvent to provide a first mixture;

heating the first mixture to a second temperature; and separating agglomerated asphaltenes from the first mixture to provide a first product comprising the non-vaporized hydrocarbon and at least a portion of the solvent and a second product comprising the agglomerated asphaltenes and the remaining portion of the solvent.

13. The method of claim 12, wherein the vaporized hydrocarbon mixture comprises about 0.5 wt % to about 6 wt % of the hydrocarbon.

14. The method of claim 12, further comprising separating at least a portion of the solvent from the first product to provide deasphalted oil and a first recovered solvent;

separating at least a portion of the solvent from the second product to provide asphaltenes and a second recovered solvent;

combining at least a portion of the first recovered solvent and the second recovered solvent to provide a combined recovered solvent;

condensing at least a portion of the combined recovered solvent to provide a condensed solvent; and recycling at least a portion of the condensed solvent to provide at least a portion of the solvent mixed with the residual hydrocarbon.

15. The method of claim 12, wherein the second temperature is equal to or greater than the supercritical temperature of the solvent.

16. The method of claim 12, wherein the pressure of the pressurized hydrocarbon is reduced to about atmospheric pressure.

17. The method of claim 12, wherein the heavy metals comprise nickel, vanadium, or mixtures thereof, and wherein the pressurized hydrocarbon further comprises about 2 wt % to about 6 wt % sulfur, about 10 wt % to about 30 wt % asphaltenes, and about 1 wt % to about 30 wt % bitumen.

18. The method of claim 12, wherein the hydrocarbon comprises untreated hydrocarbons obtained from a subterranean formation.

19. A method for deasphalting a hydrocarbon comprising:

heating a hydrocarbon comprising about 100 ppmw to about 1,000 ppmw vanadium and about 2 wt % to about 6 wt % sulfur to a temperature of about 150° C. to about 600° C.;

pressurizing the hydrocarbon comprising about 100 ppmw to about 1,000 ppmw vanadium and about 2 wt % to about 6 wt % sulfur to a pressure of about 300 kPa to about 3,000 kPa;

reducing the pressure of the pressurized hydrocarbon comprising about 100 ppmw to about 1,000 ppmw vanadium and about 2 wt % to about 6 wt % sulfur to separate at least a portion of the hydrocarbon to provide a vaporized hydrocarbon mixture and a residual hydrocarbon comprising asphaltenes and non-vaporized hydrocarbon;

mixing the residual hydrocarbon with a solvent to provide a first mixture;

heating the first mixture to a second temperature;

separating agglomerated asphaltenes from the first mixture to provide a first product comprising the non-vaporized hydrocarbon and at least a portion of the solvent and a second product comprising the agglomerated asphaltenes and the remaining portion of the solvent;

separating at least a portion of the solvent from the first product to provide deasphalted oil and a first recovered solvent;

separating at least a portion of the solvent from the second product to provide asphaltenes and a second recovered solvent;

combining at least a portion of the first recovered solvent and the second recovered solvent to provide a combined recovered solvent;

condensing at least a portion of the combined recovered solvent to provide a condensed solvent; and recycling at least a portion of the condensed solvent to provide at least a portion of the solvent mixed with the residual hydrocarbon.

* * * * *